US006564945B1

(12) United States Patent
Weinstein et al.

(10) Patent No.: US 6,564,945 B1
(45) **Date of Patent: *May 20, 2003**

(54) MEDICATION ASSEMBLAGE FOR USE IN SINUSITIS TREATMENT REGIMENS

(76) Inventors: Robert E. Weinstein, 177 Commonwealth Ave., Boston, MA (US) 02116; Alan M. Weinstein, 9205 Pegasus Ct., Potomac, MD (US) 20854

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 545 days.

(21) Appl. No.: 08/891,918

(22) Filed: Jul. 14, 1997

(51) Int. Cl.[7] ..... B65D 83/04
(52) U.S. Cl. ..... 206/531; 206/534.1; 206/459.5
(58) Field of Search ..... 206/531, 534, 206/534.1, 539, 454.5

(56) References Cited

U.S. PATENT DOCUMENTS

| | | | | | |
|---|---|---|---|---|---|
| 3,497,982 | A | * | 3/1970 | Schulz | 206/534 |
| 3,921,806 | A | * | 11/1975 | Wawracz | 206/534 |
| 4,039,080 | A | * | 8/1977 | Cappuccilli | 206/534 |
| 4,148,273 | A | * | 4/1979 | Hollingsworth et al. | 116/325 |
| 4,295,567 | A | | 10/1981 | Knudsen | |
| 4,318,477 | A | * | 3/1982 | Kerpe | 206/534 |
| 4,473,156 | A | * | 9/1984 | Martin | 206/534 |
| 4,567,986 | A | * | 2/1986 | Eastwood | 206/532 |
| 4,749,085 | A | * | 6/1988 | Denney | 206/534 |
| 4,889,238 | A | * | 12/1989 | Batchelor | 206/535 |
| 4,958,736 | A | * | 9/1990 | Urheim | 206/531 |
| 5,050,739 | A | * | 9/1991 | Hannan et al. | 206/531 |
| 5,788,974 | A | * | 8/1998 | D'Amico et al. | 424/405 |
| 5,789,391 | A | * | 8/1998 | Jacobus et al. | 514/51 |
| 5,827,852 | A | * | 10/1998 | Russell et al. | 513/255 |

OTHER PUBLICATIONS

Photographs of product sold by Proctor & Gamble under tradename HELIDAC Therapy, showing box packaging and single day blister packs.

* cited by examiner

*Primary Examiner*—Shian Luong
(74) *Attorney, Agent, or Firm*—Robert R. Deleault, Esq.; Mesmer & Deleault, PLLC

(57) ABSTRACT

A unified medication assemblage comprising a multiplicity of medications, functional indicia, and instructions for coordinating the medications together as a regimen. The medication dosages are retained in blister packs or pouches, are organized into event modules associated with particular daily events, and have corresponding event indicia. In one embodiment, the event modules are further organized into day modules having day indicia. In another embodiment, the event modules are organized into compartments of a box.

4 Claims, 5 Drawing Sheets

MEDICATION ASSEMBLAGE FOR USE IN SINUSITIS TREATMENT REGIMENS

BACKGROUND OF THE INVENTION

1. Field of the Invention

The present invention relates to the prescription medical treatment for sinusitis, more specifically, to a medicinal package that improves compliance with the treatment regimen prescribed for sinusitis.

2. The Prior Art

Sinusitis is a common disorder affecting an estimated 10% of the United States population and affecting all age groups, including children and the elderly. The problem is increasing in prevalence and in 1994, sinusitis accounted for 25 million office visits to physicians in the United States. Sinusitis can be defined as an inflammation of the paranasal sinuses which manifests as a purulent (infected) nasal discharge, nasal congestion, pain in the sinus areas (cheeks, forehead, around eyes, sides of nose), which may be associated with fever, headache, dental pain, earache, post-nasal discharge, cough, sore throat, conjunctival inflammation, foul breath, and olfactory loss. Its temporal manifestations vary from an acute illness of less than three weeks, to recurring episodes, to an unremitting chronic condition. Complications of inadequately treated sinusitis, in addition to chronicity, can be grave because of the proximity of the sinuses to the bony walls enclosing the eyes (orbits) and brain, and include orbital celulitis, optic neuritis, cavernous sinus thrombosis, epidural and subdural infection, meningitis, cerebritis, brain abscess, blindness, and even death.

The management of sinusitis is predicated upon what is known of the pathophysiology of this disorder. The paranasal sinuses consist of a series of bony pouches adjacent to the nasal cavity in the frontal, maxillary, ethmoid and sphenoid regions, which are lined by pseudostratified, ciliated epithelium. Mucous is produced by epithelial goblet cells and submucosal seromucous glands. The blanket of mucous covering the epithelial surface of the sinuses is moved in an orderly fashion by cilia towards natural ostea which lead into the nasal cavity, thereby allowing constant drainage of the sinuses. When the flow of mucous from the sinuses is interrupted, the retained secretions become thickened, the adjacent mucous membranes become inflamed and both mucous and sinus membranes are subject to infection.

Pharmacotherapy for sinusitis is therefore directed at:

(1) reestablishing patency of the sinus ostea (openings), (2) reestablishing the orderly flow of mucous, and (3) treating the infection. These three objectives conventionally require multiple prescriptions of individual medications, with a typical regimen including: (1) an oral decongestant to shrink the swelling of the sinus membranes thereby opening the sinus exit pathway, (2) an expectorant to increase respiratory tract fluid secretions, reduce their viscosity, and increase the efficacy of the mucociliary mechanism and facilitate mucous flow, and (3) an antibiotic to treat the infection.

The choice of medications and their use together are dependent on numerous considerations besides the mechanism of action and risks of the individual medications. These considerations include absorption, time of onset after dosing, rate of elimination, duration of action after dosing, therapeutic effect by virtue of combination, and side effects by virtue of combination. Medication error and misuse due to a multiplicity of medications and modalities pose an additional risk. Medical and pharmaceutical expertise is clearly required to formulate a treatment regime utilizing a combination of medications and appropriate instructions for use by a lay individuals affected by sinusitis.

Success of such a treatment regimen is contingent upon compliance for a 10–14 day period for acute sinusitis and a 3–8 week period in children and individuals with chronic sinusitis. Previous compliance studies have demonstrated three important considerations which adversely affect compliance: (1) increased complexity of the treatment regimen, (2) poor patient understanding of the treatment rationale, and (3) difficulty of use. Indeed, the multiplicity of medications necessary for sinusitis treatment increases the complexity of the regimen, patients may not fully understand the benefit of each component, and the convention of multiple containers and separate instructions for each component make complying with the regimen more difficult.

United States health care experts conservatively estimate that half of the 1.8 billion prescription medications dispensed yearly are not taken as prescribed. Because of its potentially negative consequences, many consider lack of compliance with treatment regimens to be one of the most serious problems facing health care today. The multiplicity of medications necessary for effective sinusitis treatment makes it especially susceptible to non-compliance.

Solutions to the compliance problem have been put forth by others. Typical of such solutions is the compartmented pillbox, where the medications are stored in compartments representing times of the day and different days. The major shortcoming of the compartmented pillbox is that the patient still receives the medications in separate containers and then must sort the various medications and store them in the proper compartments in the pillbox. This can be a complex and difficult task, especially when the medications are similar in appearance. And there is no guarantee that the medications will be sorted and stored correctly.

SUMMARY OF THE INVENTION

An object of the present invention is to provide a means for increasing compliance with medication regimens for treating sinusitis.

Another objective is to provide a sinusitis patient with a unified, understandable, and organized treatment regimen for sinusitis.

A further object is to minimize complexity and facilitate ease of use of a sinusitis treatment regimen.

The preferred embodiments of the present invention comprise a multiplicity of medications for sinusitis physically arranged so as to simplify their use, functional indicia and instructions for coordinating the medications together as a regimen, and unification of these elements within a pharmaceutical dispensing assemblage.

With the present invention, all of the medications for the treatment regimen are prepackaged into a single prescription package for the patient. The patient only deals with a single package, rather than the multiplicity of packages of the prior treatment regimens. The medication is organized into event modules associated with daily events at which the medication is taken. The event may be a time of day or an activity that is performed during the day. Indicia representing the events associated with the event modules lead the patient clearly through the treatment regimen over its full time period, leading to a greater degree of compliance with the regimen and a greater probability that the treatment will be successfully completed.

The medication dosages are stored in either blister packs or pouches. The blister pack includes a clear plastic sheet with pockets for the dosages and a rupturable or pealable cover for retaining the dosages in their pockets until manually removed. The pouch is a bag composed of thin sheets of plastic or foil and is typically opened by tearing. The present invention can be used with many physical forms of medication, but the preferred forms are those that are most easily taken, such as tablets, capsules, and liquid-gels.

There are two basic preferred embodiments of the present invention, the box embodiment and the card embodiment. The box embodiment includes a box and a plurality of event modules. Each event module is either a blister pack or a pouch and is identified by an event indicia. A set of one day's worth of event modules may be physically combined into a day group. The event modules are organized within the box to present the treatment regimen in a logical progression. In one form, the box has dividers that define compartments, where all of the event modules for one event reside within one associated compartment. In another form, the box is tall, with a slot on one side at the bottom through which one event module fits. The event modules are stacked within the container in chronological order or are all connected together and rolled into a loop. Each event module is removed from the box when needed by sliding it out of the slot.

The card embodiment includes a number of medication dosages in a blister pack container organized into day modules and event modules. Each day module represents a single day of the treatment regimen and includes one of each type of event module. The day modules are arranged in single or multiple rows or columns. All of the event modules of a single row or column that are defined by the same event are arranged in a continuous line. Each day module includes a day indicia indicating the day of the treatment regimen that the dosages of that day module are to be taken and each event module line is associated with an event indicia. Optionally, the day modules are delimited by perforations that allow the manual separation of a day module from the card.

In all embodiments, the assemblage includes an instruction area which contains any information deemed necessary to the safe use of the medications. Such information includes, but is not limited to, a graphical depiction of each event module, a graphical medication legend, and instructions for use.

Other objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION

The present invention simplifies the regimen necessary to effectively treat sinusitis by organizing, teaching, and coordinating the combined use of multiple therapeutic agents. The result is a reduction in medication error and an increase in therapeutic compliance.

There are two basic preferred embodiments of the present invention, the box embodiment and the card embodiment. Both embodiments comprise a multiplicity of medications for sinusitis physically arranged so as to simplify their use, functional indicia and instructions for coordinating the medications together as a regimen, and unification of these elements within a pharmaceutical dispensing assemblage.

The physical form that the medication takes includes, but is not limited to, tablets, capsules, liquid-gels, liquids, and packets requiring reconstitution. The preferred forms are those that are most easily taken by a patient. One object of the present invention is to simplify the treatment regimen in order to improve compliance. The simpler the medications and their relationships are to perceive and take, the more likely the patient is to comply with the treatment regimen. If a medication is used in a form that is difficult to use or potentially messy, such as liquids or packets needing reconstitution, a patient is less likely to comply with the regimen. Thus, these forms of medication are less preferred than simpler-to-use forms such as tablets, capsules, and liquid-gels.

With the present invention, the patient only deals with a single package, rather than the multiplicity of packages of prior art treatment regimens. This unitary package is designed so that the treatment regimen is immediately comprehended by visual inspection. The medication is arranged so that each dosage of the treatment regimen is presented in a logical progression. The basic progression takes the form of event modules associated with particular daily events, such as activities and/or times of day. Indicia associated with the event modules lead the patient clearly through the treatment regimen over its full time period, leading to a greater degree of compliance with the regimen and a greater probability that the treatment will be successfully completed. The indicia represent events and medications. One set of indicia, the event indicia, indicates the time of day or the activity with which the dosages of each event module is to be taken. A second set of indicia, the legend indicia, identifies each of the medications by visual appearance in the event that detailed knowledge of the exact medications should become necessary.

Box Embodiment

Figure 1:
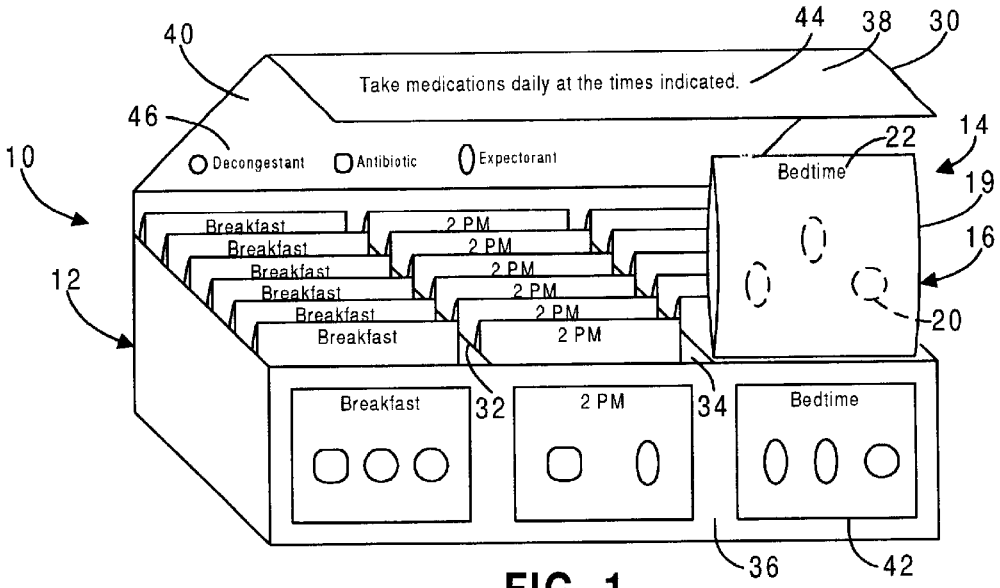
FIG. 1 is a perspective view of one configuration of the box embodiment of the present invention.

One configuration of the box embodiment 10 is shown in FIG. 1. The assemblage includes a box 12 and a plurality of event modules 14. An event module 14 contains the medication dosages to be taken at the occurrence of a predetermined event. The event is a time of day and/or an activity that is performed during the day. An event group includes all of the event modules 14 associated with the same daily event.

Each event module 14 includes an event pack 16, at least one medication dosage 20, and an event indicia 22.

Figure 2:
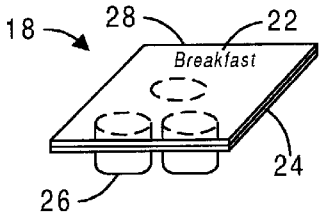
FIG. 2 is a perspective view, in partial phantom, of an event module for the embodiment of FIG. 1.

Preferably, the event pack 16 is either a blister pack 18 or a pouch 19. The blister pack 18, shown in FIG. 2, is preferably formed of a clear plastic sheet 24 with pockets 26 for receiving the dosages and a rupturable or pealable aluminum cover 28 for retaining the dosages in their pockets 26 until manually removed. The cover 28 seals the pocket 26 to prevent contamination of the medication inside. The size of the pockets 26 depends upon the form and size of the medication and on how many medications are in the pocket 26. Typically, there is one dosage of one medication in each pocket 26, but more than one per pocket is contemplated by the present invention. In addition, different pockets may be different sizes.

The pouch 19, shown in FIG. 1, is a bag within which reside the dosages 20 to be taken at a single event. This type of pouch is well-known in the art. It is composed of either a thin sheet of plastic or foil that is folded double or two thin sheets of plastic or foil placed flat against each other. Typically, the pouch is opened by manual tearing and a nick may be put in the edge of the pouch to facilitate manual tearing. The pouch 16 is sealed to prevent contamination of the medication inside.

Each event module 14 includes an event indicia 22, which indicates the event at which the dosages of that event module 14 are to be taken and any qualifiers associated with taking the dosage. The event indicia 22 takes any form that is meaningful to the patient. Examples include the time of day, such as "8 AM" and "noon", specific activities, such as "bedtime" and "with breakfast", or combinations of the two. Qualifiers are activities that should be performed in conjunction with taking the dosage. A typical qualifier is "with food" as in "6 PM with food."

Figure 3:
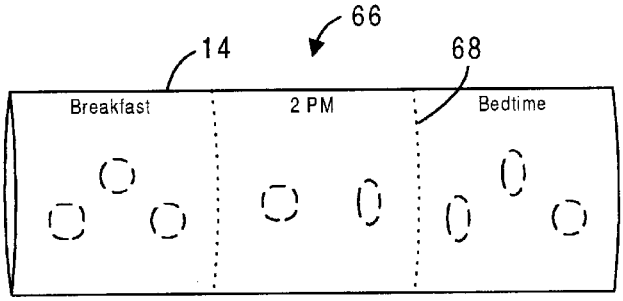
FIG. 3 is a perspective view of a day group of event modules.

For each day of the treatment regimen there are at least two event modules. In FIG. 1, the event modules 14 are shown as being separate. In another configuration, all of the event modules 14 from a single day are connected together in a day group 66, as in FIG. 3. Optionally, there are perforations 68 separating the event modules 14 so that they may be easily separated by hand. The day group 66 may be organized as a linear string, as in FIG. 3, or as a square or rectangular matrix.

The event modules 14 are organized within the box 12 to present the treatment regimen in a logical progression. In one form, shown in FIG. 1, the box 12 is rectangular with top-opening cover 30 and front-to-back dividers 32 that define event compartments 34. All of the event modules 14 for one event reside within one associated event compartment 34. Preferably, the event indicia 22 on the front-most event module 14 is visible when the box 12 is opened.

In a second form, used with the day group 66 of event modules 14, there are no dividers. Rather, each day group 66 stretches from one side of the box to the other. Preferably, the event indicia 22 on the event modules 14 of the front-most day group 66 is visible when the box 12 is opened.

The box 12 also includes an instruction area 42, 44, 46, which contains any information deemed necessary to the correct use of the medications. Such information might include a graphical depiction of each event module 14, a graphical medication legend, and instructions for use. The location of the instruction area depends both upon the surface area needed and the surface area available. In the example of FIG. 1, the instruction area is located on the box front surface 36, the cover flap 38, and the cover inside surface 40. The front surface 36 includes graphical descriptions 42 of the event modules 14 aligned with the associated compartments 34. The flap 38 includes the instructions for use 44, and the cover inside surface 40 includes a legend 46 identifying the particular medications by appearance, should identification become necessary.

Figure 4:
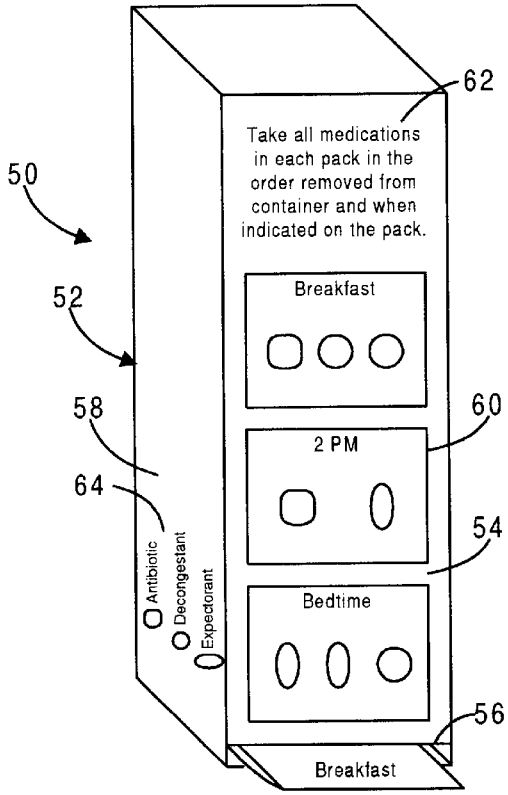
FIG. 4 is a perspective view of another configuration of the box embodiment of the present invention.

In another form 50, shown in FIG. 4, the box 52 is tall and rectangular and has a width slightly larger than the largest event module 14. At the bottom of the front 54 of the box 52 is an opening 56 through which one event module 14 fits. The event modules 14 are stacked within the container in chronological order, with the first event module to be used at the bottom. Each event module 14 is removed from the box 52 when needed by sliding it out of the slot 56.

Optionally, the event modules 14 for the box 52 of FIG. 4 are linearly connected in chronological order to form a string. There is a perforation between each event module 14. The string is rolled up with the first event module 14 on the outside and placed in the box 52. Each event module 14 is pulled from the box 52 and torn from the string as needed.

The instruction area 60, 62, 64 is located on the various container outer surfaces. For example, the front surface 54 includes a graphical depiction 60 of each event module 14 and the instructions for use 62, and a legend 64 for identifying the particular medications by appearance is located on a side surface 58.

Card Embodiment

The card embodiment is shown in FIGS. 5–8. The assemblage 70 includes a container 72 and a plurality of event modules 74. The assemblage 70 includes a number of medication dosages 76 in a blister pack 78. The blister pack 78 is,a larger version of the blister pack 18 described above with reference to the box embodiment 10.

The event modules 74 are combined into a series of day modules 80. Each day module 80 represents a single day of the regimen and includes one of each event module 74. In the assemblage 70 of FIG. 5, the day modules 80 are arranged in a single row 82. However, in some situations, arranging all of the day modules 80 in a single row results in an assemblage that is awkward to handle or store. In the assemblage 84 of FIG. 6, the line of day modules 80 is broken into two rows 86, 88, one over the other. Because, a single day module or small group of day modules is easier to carry than the entire assemblage, the day modules 80 are optionally delimited by perforations 90 that allow the manual separation of a day module 80 from the assemblage. The perforations 90 are robust enough so that it takes at least manual force to separate the day modules 80.

Each day module 80 includes a day indicia 92. The day indicia 92 has two preferred forms. In one form, shown in FIG. 5, the day indicia 92 includes a numeral representing the sequential day of the treatment regimen. For example, the day module of dosages for the first day of the regimen will be labeled "Day 1", the second day would be labeled "Day 2", and so on. This form of indicia is date-independent and, therefore, lends itself to being placed on the assemblage early in the production process.

Figure 6:
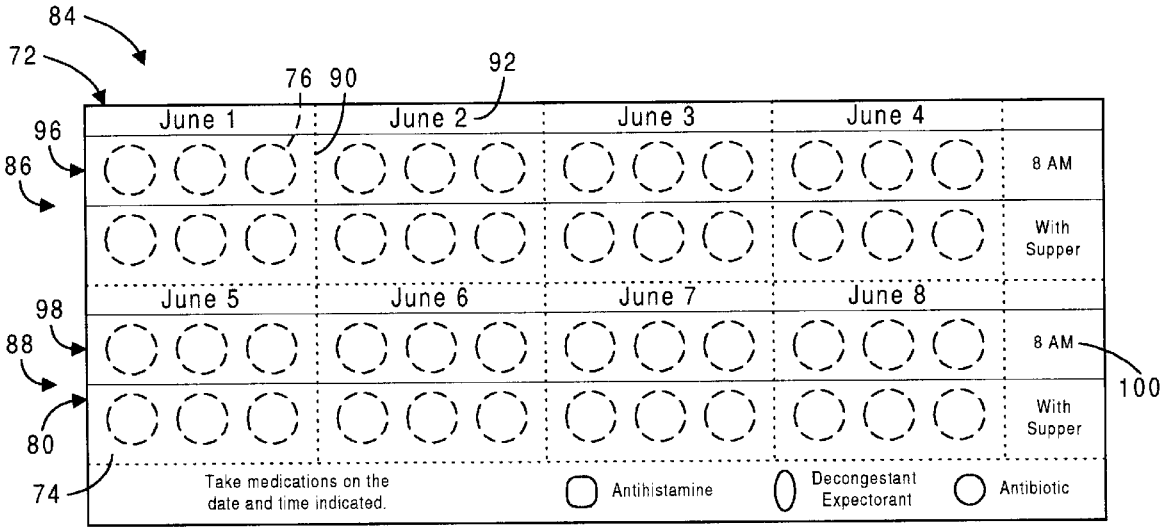
FIG. 6 is a top view, in phantom, of another configuration of the card embodiment of the present invention.

In the second form, shown in FIG. 6, the day indicia 92 is a date representing the actual date that the dosages of that module is to be taken. The date form of the day indicia may include the day of the week, day of the month, month, or year, or any combination of these. Since it is not practical to have every possible combination of dates in which the present invention could be used, the dates are put on the assemblage just prior to dispensing the assemblage to the patient. This form of day indicia lends itself to being more comprehensible to the patient than the above-described first preferred form, but is more labor-intensive, increasing the cost of the product.

Each day module 80 is composed of at least two event modules 74. All of the event modules 74 of a single row that are defined by the same event are arranged in a continuous line. This means that, in the assemblage 70 of FIG. 5, there will be only one line 94 of event modules 74 of the same event and, in the assemblage 84 of FIG. 6, there will be two lines 96, 98 of event modules 74 of the same event.

Each event modules line 94, 96, 98 is identified by an event indicia 100, which indicates the event at which the dosages of that line are to be taken. The event indicia 100 is as described above with reference to the box embodiment. If the day modules 80 are delimited by perforations so that they may be separated, it is preferred that every day module 80 be imprinted with the event indicia 100, or at least an abbreviation that is comprehensible, so that the event indicia 100 does not have to be remembered or manually written on each day module 80 that is removed from the assemblage.

Figure 5:
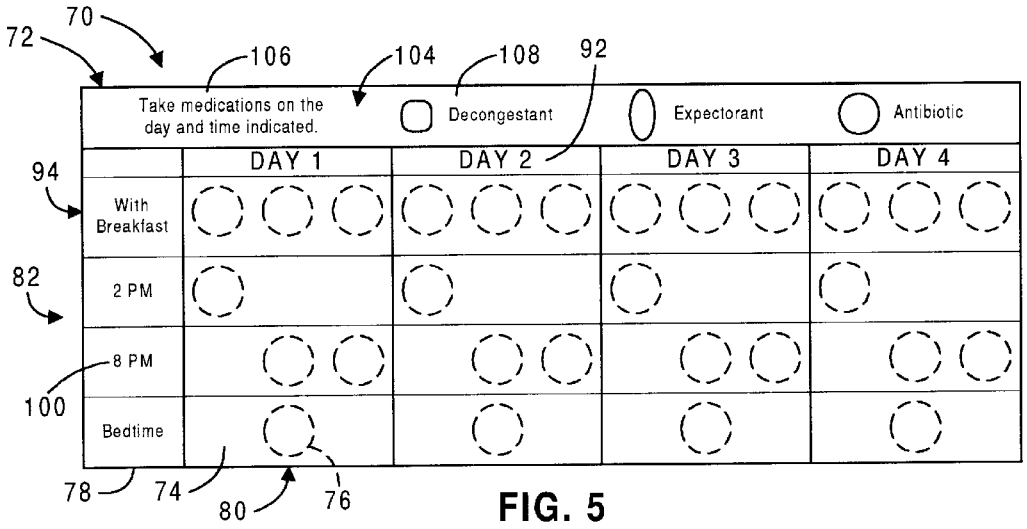
FIG. 5 is a top view, in phantom, of one configuration of the card embodiment of the present invention.
Figure 7:
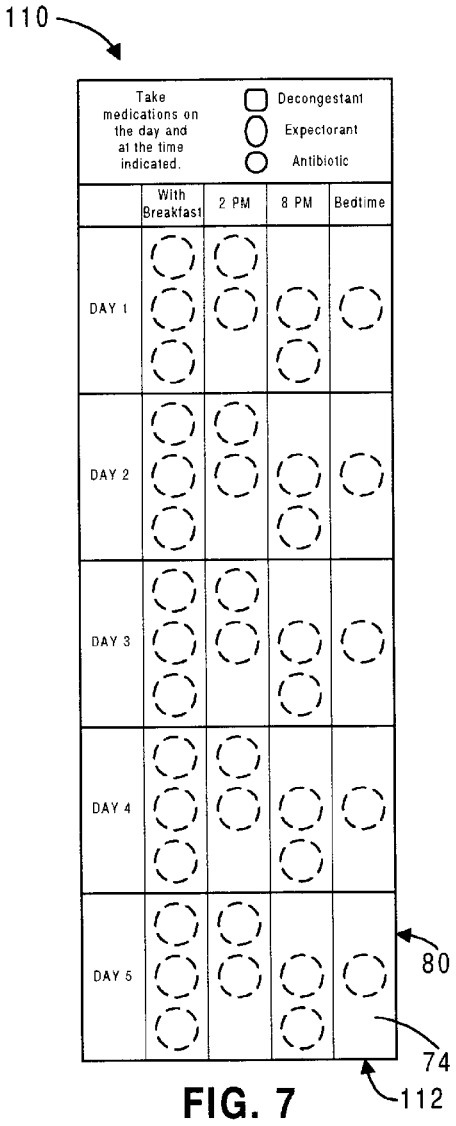
FIG. 7 is a top view, in phantom, of a third configuration of the card embodiment of the present invention.

An alternate arrangement of day modules 80 and event modules 74 to that shown in FIGS. 5 and 6 is shown in the assemblage 110 of FIG. 7. In this assemblage 110, the day modules 80 and event modules 74 are organized into columns 112, rather than rows. Similarly to FIG. 6, the event modules 74 may be divided into two or more columns.

Figure 8:
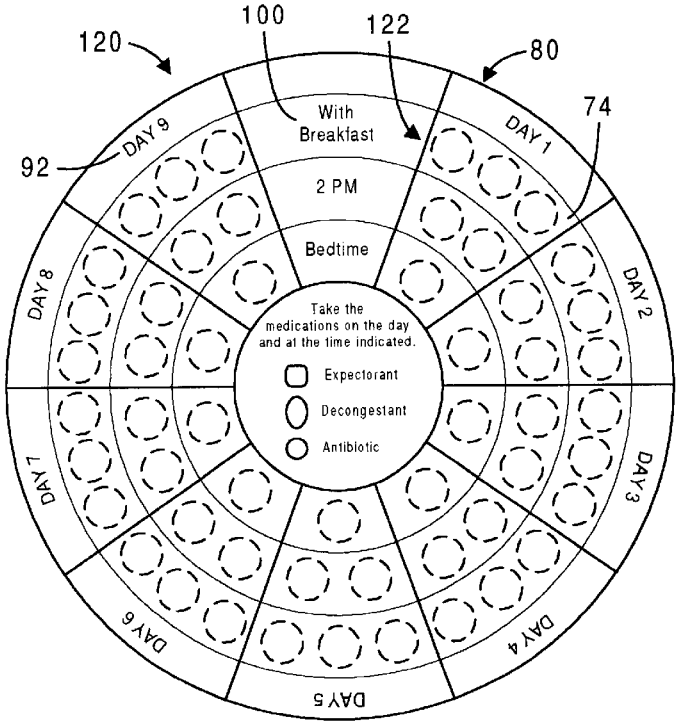
FIG. 8 is a top view, in phantom, of a fourth configuration of the card embodiment of the present invention.

Another alternate arrangement of day modules 80 and event modules 74 is shown in the assemblage 120 of FIG. 8. In this assemblage 120, the day modules 80 are arranged like the spokes of a wheel, where the event modules 74 are stacked radially along the spoke. Here each spoke is a day module 80 and a event module 74 from each day module 80 form a circle 122 concentric about the center. The circle 122 is analogous to the line 94 of FIG. 5. There is a day indicia 92 for each day module 80 and an event indicia 100 for each circle 122.

The regular arrangement of day modules 80 with their associated day indicia 92 and event modules 74 with their associated event indicia 100 form a logical and easily comprehensible progression of time defining the timeline of the treatment regimen.

The assemblage also includes an instruction area 104 in which are located instructions 106 and a legend 108 for identifying the particular medications by appearance, should identification become necessary. In assemblages in which the day modules 80 are delimited by perforations 90, each day module 80 optionally includes an instruction area.

EXAMPLE TREATMENT REGIMENS

Figure 9:
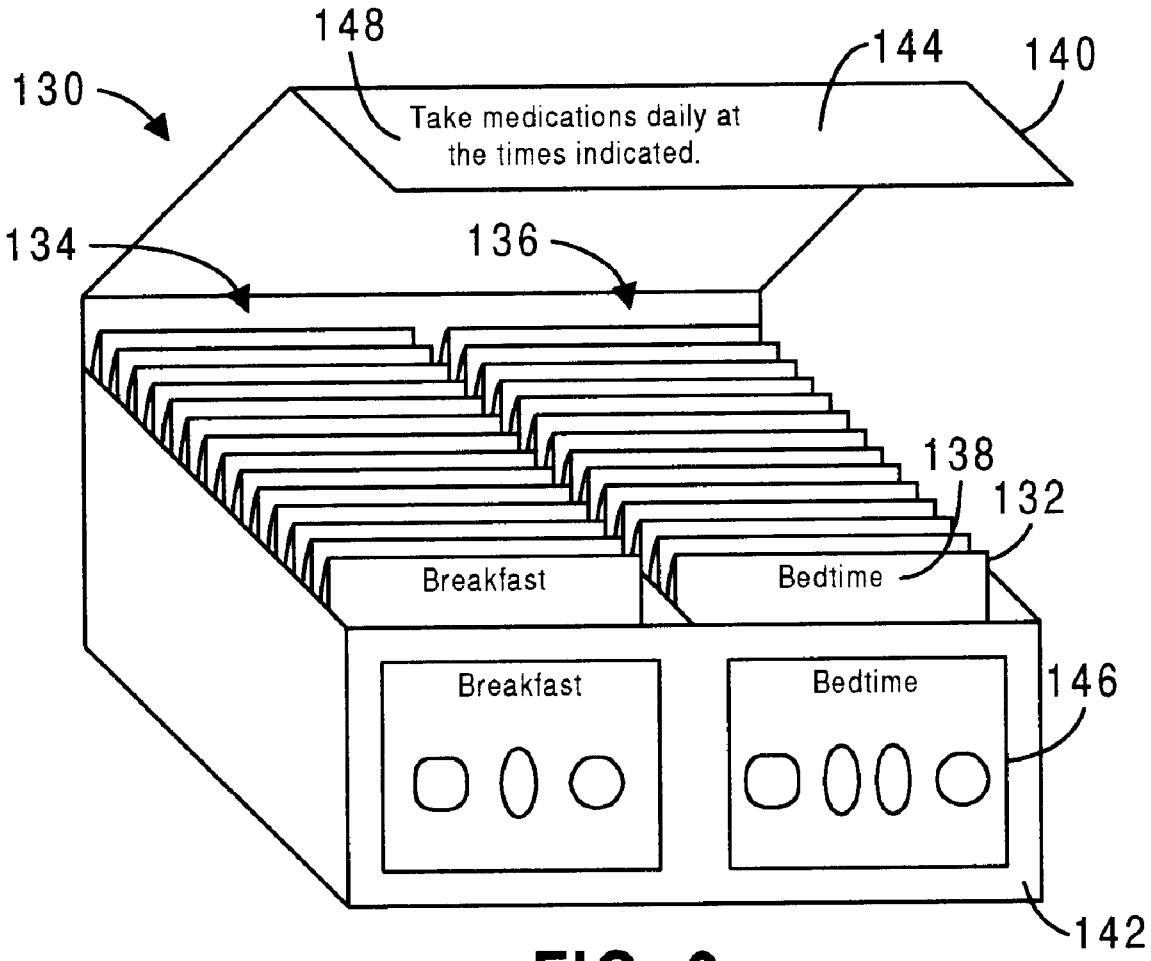
FIG. 9 is a top view, in phantom, of an example treatment regimen using the present invention.

One example of a treatment regimen that continues for 14 days includes (1) decongestant and expectorant tablets of 120 mg pseudoephedrine HCL and 600 mg guiafenesin, one tablet each at breakfast and at bedtime, (2) antihistamine tablets of 25 mg diphenhydramine, one at breakfast and two at bedtime, and (3) antibiotic tablets of 160 mg trimethoprim and 160 mg sulfamethoxazole, one each at breakfast and at bedtime. An example assemblage for this regimen is shown in FIG. 9. This assemblage 130 has 28 event modules 132, two for each day of the regimen and are arranged in two rows 134, 136 of 14 event modules 132. The left row 134 includes the event modules 132 having dosages to be taken with breakfast and the right row 136 includes the event modules 132 having dosages to be taken at bedtime. The event indicia 138 is located at the top of each event module 132 so it is seen when the cover 140 is opened. The instruction area is located on both the container tray front surface 142 and the container cover flap 144. The tray front surface 142 includes the event module 132 and medication legend 146 and the cover flag 144 includes the instructions 148.

This regimen is particularly suitable for an individual in whom allergy is considered to underlie blockage of the sinus ostia and cause sinusitis. In such individuals, the mediator histamine is released during exposure to the allergenic substance. Histamine causes swelling of tissues and can be prevented with an antihistamine such as diphenhydramine. One of the side effects of diphenhydramine is drowsiness and accordingly a larger dosage is utilized at night. Stimulation by the pseudoephedrine taken in the morning is likely to sufficiently counteract any sedation caused from the smaller dose of diphenhydramine taken during daytime hours. The choice of antibiotic avoids the use of penicillin to which this allergic person is also sensitive. This combination of medications thus accomplishes ostial patency and reduced swelling with the decongestant and antihistamine, increased mucous flow and reduced viscosity of mucous with the expectorant, and penicillin-free antibiotic action for an allergic individual with sinusitis.

Figure 10:
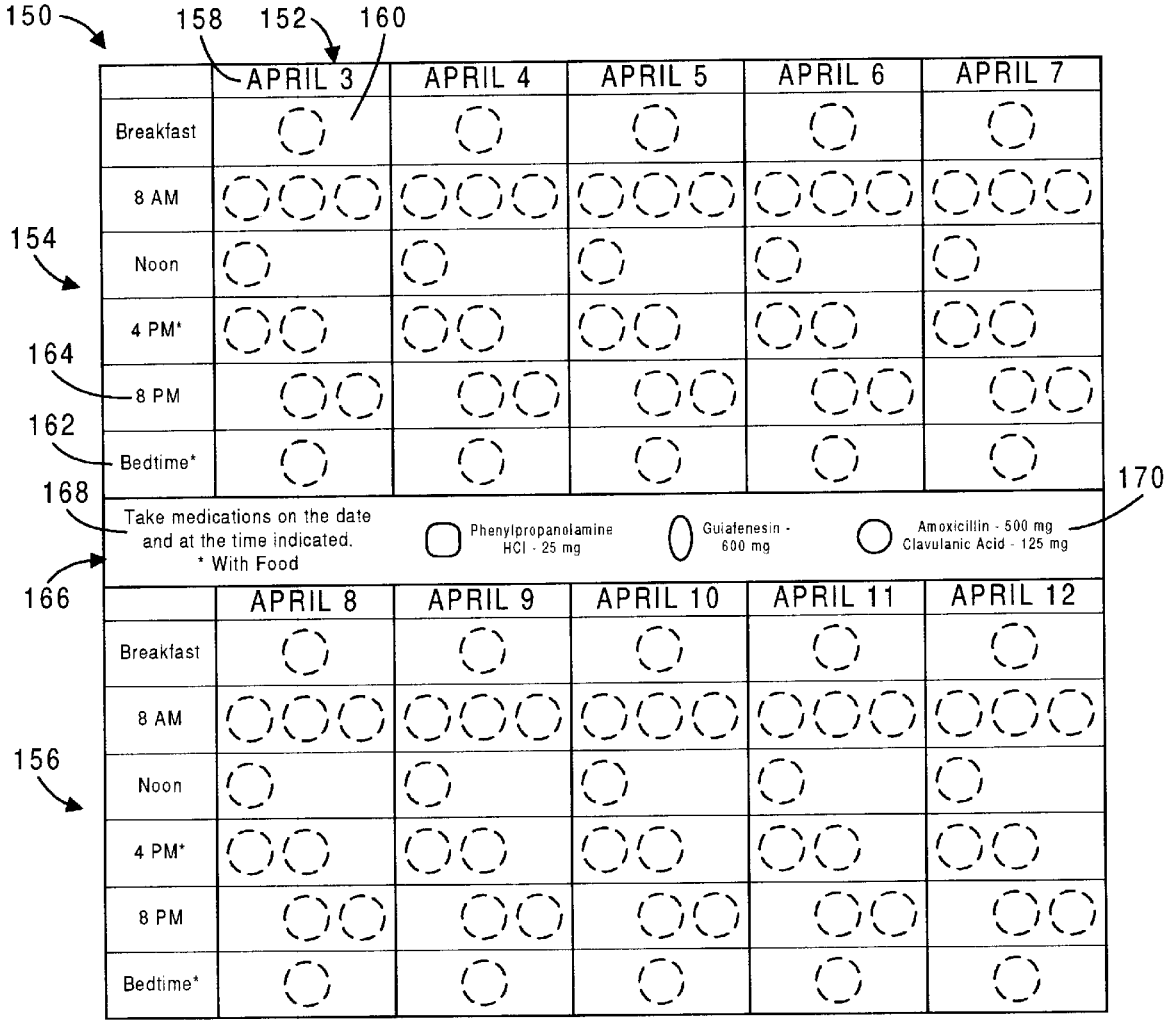
FIG. 10 is a top view, in phantom, of another example treatment regimen using the present invention.

Another example of a treatment regimen that continues for 10 days includes (1) nasal decongestant tablets of 25 mg phenylpropanolamine HCl, one tablet taken at 8 AM, noon, and 4 PM, (2) expectorant tablets of 600 mg guiafenesin, two tablets taken at 8 AM and 8 PM, and (3) antibiotic tablets of 500 mg amoxicillin and 125 mg clavulanic acid, one tablet before breakfast, at 4 PM with a snack, and at bedtime with a snack. An example assemblage for this regimen is shown in FIG. 10. The assemblage 150 includes 10 day modules 152, one for each day of the regimen and which are arranged in two rows 154, 156 of 5 day modules 152. The top row 154 includes the day modules 152 for the first half of the regimen and the bottom row 156 includes the day modules 152 for the last half of the regimen. In this example, the day indicia 158 are the dates when the dosages of that day module 152 are to be taken. There are six event modules 160 in each day module 152, one for each event at which the dosages of the event module 160 are to be taken. The event module indicia 162, 164 are located at one end of the rows 154, 156 and specify an activity, as at 162, or time of day, as at 164. The instruction area 166 is located between the rows 154, 156 and includes instructions 168 and a medication legend 170.

This regimen attempts to maximize the therapeutic effects of each agent and minimize their side effects. (The decongestant medication, phenylpropanolamine, is only used during the daytime hours because it commonly causes insomnia. The expectorant, guiafenesin, is used both day and night to thin secretions. The somnolence that might occasionally be experienced with this medication is likely to be counteracted by the stimulation of the phenylpropanolamine taken during the day. The antibiotic agent is used on a 24-hour basis, which is effective for Streptococcus pneumoniae, haemophilus influenza, and, Moraxella catarrhalis, microorganisms most commonly infecting the sinuses. This antibiotic is more efficiently absorbed with meals but is best taken at the start of meals to avoid gastronintestinal upset.

These two illustrations are intended only as examples of treatment regimens which can be advantageously incorporated into the present invention. They are examples of antibiotics that might be incorporated with other medications deemed salutary for the treatment of sinusitis and its associated manifestations including: decongestants, analgesics, expectorants, mucolytics, anti-inflammatory agents, cell stabilizers, cough suppressants, and mediator antagonists to form a sinusitis treatment regimen.

Thus it has been shown and described a medicinal package which satisfies the objects set forth above.

Since certain changes may be made in the present disclosure without departing from the scope of the present invention, it is intended that all matter described in the foregoing specification and shown in the accompanying drawings be interpreted as illustrative and not in a limiting sense.

What is claimed is:

1. A therapeutic sinusitis treatment system for reducing medication error and enhancing therapeutic compliance, said system comprising:

(a) a plurality of dosages of an oral antibiotic effective for treating sinusitis caused by at least one of the organisms from the class consisting of Streptococcus pneumoniae, Haemophilis influenza, and Moraxella catarrhalis;

(b) a plurality of dosages of at least one active treatment oral medication selected from the class consisting of decongestant, expectorant, mucolytic, anti-inflammatory agent, cell stabilizer, and mediator antagonist wherein said plurality of dosages of said oral antibiotic and said plurality of dosages of said at least one active treatment oral medication comprise a therapeutic regimen lasting at least ten days;

(c) a prepackaged blister pack which incorporates said dosages; and (d) instructions incorporated with said blister pack for coordinating use of said dosages together.

2. A therapeutic sinusitis treatment system for reducing medication error and enhancing therapeutic compliance, said system comprising:

(a) a plurality of dosages of an oral antibiotic effective for treating sinusitis caused by at least one of the organisms from the class consisting of Streptococcus pneumoniae, Haemophilis influenza, and Moraxella catarrhalis;

(b) a plurality of dosages of at least one active treatment oral medication selected from the class consisting of decongestant, expectorant, mucolytic, anti-inflammatory agent, cell stabilizer, and mediator antagonist wherein said plurality of dosages of said oral antibiotic and said plurality of dosages of said at least one active treatment oral medication comprise a therapeutic regimen lasting at least ten days;

(c) a prepackaged blister pack which incorporates said dosages within a plurality of modules, each of said modules including at least one of said dosages, each of said modules being associated with a particular predetermined event at which said at least one dosage is taken, said event being selected from the group consisting of a time of day and an activity performed during a day, all of said modules associated with the same event including the same at least one dosage, said modules being presented in a logical progression; and (d) instructions incorporated with said blister pack for coordinating use of said dosages together.

3. A sinusitis treatment method for reducing medication error and enhancing therapeutic compliance, said method comprising:

(a) providing a plurality of dosages of an oral antibiotic effective for treating sinusitis caused by at least one of the organisms from the class consisting of Streptococcus pneumoniae, Haemophilis influenza, and Moraxella catarrhalis;

(b) providing a plurality of dosages of at least one active treatment oral medication selected from the class consisting of decongestant, expectorant, mucolytic, anti-inflammatory agent, cell stabilizer, and mediator antagonist wherein said plurality of dosages of said oral antibiotic and said plurality of dosages of said at least one active treatment oral medication comprise a therapeutic regimen lasting at least ten days;

(c) providing a blister pack device which incorporates said dosages; and (d) incorporating instructions into said blister pack for use such that said dosages are coordinated together as a therapeutic regimen.

4. A sinusitis treatment method for reducing medication error and enhancing therapeutic compliance, said method comprising:

(a) providing a plurality of dosages of an oral antibiotic effective for treating sinusitis caused by at least one of the organisms from the class consisting of Streptococcus pneumoniae, Haemophilis influenza, and Moraxella catarrhalis;

(b) providing a plurality of dosages at least one active treatment oral medication selected from the class consisting of decongestant, expectorant, mucolytic, anti-inflammatory agent, cell stabilizer, and mediator antagonist wherein said plurality of dosages of said oral antibiotic and said plurality of dosages of said at least one active treatment oral medication comprise a therapeutic regimen lasting at least ten days;

(c) providing a blister pack device which incorporates said dosages within a plurality of modules, each of said modules including at least one of said dosages, each of said modules being associated with a particular predetermined event at which said at least one dosage is taken, said event being selected from the group consisting of a time of day and an activity performed during a day, all of said modules associated with the same event including the same at least one dosage, said modules being presented in a logical progression; and (d) incorporating instructions into said blister pack for use such that said dosages are coordinated together as a therapeutic regimen.

* * * * *